US007147504B2

(12) United States Patent
Ikeya et al.

(10) Patent No.: US 7,147,504 B2
(45) Date of Patent: Dec. 12, 2006

(54) LEVER-FITTING TYPE CONNECTOR

(75) Inventors: Kenichi Ikeya, Shizuoka-ken (JP); Yasuhiro Sasaki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/214,973

(22) Filed: Aug. 31, 2005

(65) Prior Publication Data

US 2006/0046540 A1 Mar. 2, 2006

(30) Foreign Application Priority Data

Sep. 1, 2004 (JP) ..... 2004-254661

(51) Int. Cl.
*H01R 13/627* (2006.01)

(52) U.S. Cl. ..... 439/364; 439/381

(58) Field of Classification Search ..... 439/364, 439/381

See application file for complete search history.

(56) References Cited

U.S. PATENT DOCUMENTS 5,376,016 A * 12/1994 Inaba et al. ..... 439/364
5,501,606 A 3/1996 Oda et al.
5,533,909 A * 7/1996 Endo et al. ..... 439/381
5,556,288 A * 9/1996 Ishii et al. ..... 439/135
5,599,200 A * 2/1997 Yagi et al. ..... 439/381
5,720,624 A * 2/1998 Ikeda ..... 439/364
5,993,255 A * 11/1999 Yurko ..... 439/595
6,004,158 A 12/1999 Ward
6,171,133 B1 * 1/2001 Altuner et al. ..... 439/381
6,726,498 B1 * 4/2004 Pogliani ..... 439/272
6,939,163 B1 * 9/2005 Fujita ..... 439/381

FOREIGN PATENT DOCUMENTS

EP 1 213 799 A1 6/2002
JP 11 054203 2/1999

* cited by examiner

*Primary Examiner*—Gary F. Paumen
(74) *Attorney, Agent, or Firm*—Finnegan, Henderson, Farabow, Garrett & Dunner, L.L.P.

(57) ABSTRACT

In a lever-fitting type connector, a moving plate is accommodated in a hood part of the male connector housing. The moving plate includes a plurality of temporary engagement parts that can be slidably and temporarily engaged with the male connector housing. These temporary engagement parts are arranged on lines perpendicular to a center axis of a lever in engagement with the male connector housing. The temporary engagement part is positioned on one side of the center axis, while the other temporary engagement parts are positioned on the other side of the center axis.

6 Claims, 10 Drawing Sheets

LEVER-FITTING TYPE CONNECTOR

BACKGROUND OF THE INVENTION

The present invention relates to a lever-fitting type connector that allows female and male connector housings to be engaged to and disengaged from each other by an operator's rotational manipulation of a lever.

FIG. 1 shows a bolt-fitting type connector where female and male connector housings are engaged with each other by rotation of a bolt (Japanese Patent Publication laid-open No. 11-54203). In this bolt-fitting type connector in the figure, a female connector housing 100 is provided with a bolt 102. The bolt 102 is rotatably inserted into a bolt hole 101 formed in the female connector housing 100. In engaging the female connector housing 100 with a not-shown male connector housing, the leading end of the bolt 102 is screwed into a nut fixed on the male connector housing and successively rotated with respect to the nut, so that the female and male connector housings get close to each other for integration.

Note, the above-mentioned connector is equipped with a plurality of male terminals (metal fittings) projecting from a fitting surface of the male connector housing (not shown). In order to accomplish certain engagement between the male connector housing and the female connector housing 100 while maintaining respective distances among the male terminals appropriately, there is used a not-shown plate called "moving plate", which has small holes (terminal insertion holes) formed to allow the male terminals to be inserted thereinto respectively, corresponding to respective positions of the male terminals. The above "moving plate" is formed so as to be temporarily engageable with respective tips of the male terminals projecting from the fitting surface of the male connector housing and also passing through the terminal insertion holes respectively. In other words, the moving plate is provided with temporary engagement parts for temporary engagement with the male connector housing. In engaging the female connector housing with the male connector housing, the moving plate in temporary engagement with the male connector housing is urged by the leading surface of the female connector housing. Then, the male connector housing is configured to slide toward the backside of the male connector housing while maintaining respective distances among the male terminals.

In reality of the above-mentioned bolt-fitting type connector, however, it is often the case that if pressures of the temporary engagement parts acting on the male connector housing differ from each other slightly, then the moving plate slides toward the backside of the male connector housing while being inclined to the male connector housing. Such an inclination of the moving plate to the male connector housing may cause the above distances among the male terminals to be varied by the moving plate forcibly, exerting an influence on smooth engagement between the male terminals and female terminals (not shown) in the female connector housing. In some cases, there is a possibility that the male and female terminals are damaged disadvantageously.

SUMMARY OF THE INVENTION

Under the circumstances, it is therefore an object of the present invention to provide a lever-fitting type connector capable of effecting such smooth engagement between a female connector housing and a male connector housing while maintaining respective distances among terminals in the connector housings appropriately.

The object of the present invention described above can be accomplished, as the first aspect of the invention, by a lever-fitting type connector comprising: a first connector housing; a second connector housing for engagement with the first connector housing; a rod-shaped lever rotatably inserted into first connector housing and held by the first connector housing so that rotation of the lever allows the second connector housing to be dragged to the first connector housing thereby engaging the first and second connector housings with each other; a plurality of terminals arranged so as to project from a fitting surface of the second connector housing; and a moving plate interposed between the first connector housing and the second connector housing, the moving plate having a plurality of terminal insertion holes and one lever insertion hole formed to allow insertion of the terminals and the lever respectively, wherein the first connector housing is configured to slide the moving plate toward the second connector housing while keeping the terminals being inserted into the terminal insertion holes of the moving plate when the first connector housing is engaged with the second connector housing; the moving plate includes a plate body having the terminal insertion holes formed therein and a plurality of temporary engagement parts formed on the plate body to engage with the second connector housing temporarily; and the temporary engagement parts are arranged, on a plurality of lines perpendicular to a rotating axis of the lever in engagement with the second connector housing, on both sides of the rotating axis.

According to the first aspect of the invention, with the above arrangement of the temporary engagement parts, when a pressure on the side of the first connector housing is applied on the plate body of the moving plate, the temporary engagement parts are each subjected to substantially uniform pressures, allowing the plate body to be prevented from being inclined to the second connector housing. As a result, it becomes possible to move the moving plate smoothly in engaging the first connector housing with the second connector housing and also possible to ensure appropriate distances among the terminals in the second connector housing, accomplishing certain engagement between the first connector housing and the second connector housing.

As the second aspect of the invention, in the lever-fitting type connector, the temporary engagement parts are positioned on both sides of a center line of a fitting end face of the second connector housing symmetrically.

According to the second aspect of the invention, due to the symmetrical arrangement of the temporary engagement parts, the moving plate can be engaged with the second connector housing, effecting certain engagement between the first connector housing and the second connector housing.

As the third aspect of the invention, in the lever-fitting type connector, the temporary engagement parts are formed by a plurality of temporary engagement pieces in the form of arms projecting from the plate body toward the first connector housing, and the second connector housing is provided with a plurality of engaging pants allowing the temporary engagement pieces to be slidably engaged therewith.

According to the third aspect of the invention, since the temporary engagement pieces in the form of repulsive arms are engaged with the engaging parts of the second connector housing, it becomes possible for the moving plate urged by the first connector housing to slide toward the second connector housing smoothly.

As the fourth aspect of the invention, in the lever-fitting type connector of the third aspect, the first connector housing is provided with a plurality of holding parts for holding the temporary engagement parts when the first connector housing is engaged with the second connector housing.

According to the fourth aspect of the invention, owing to the provision of the first connector housing with the holding parts, it is possible to prevent the moving plate from rattling under condition that the first and second connector housings are engaged with each other, also preventing an occurrence of abnormal noise with the enhanced reliability in engaging the first connector housing with the second connector housing.

As the fifth aspect of the invention, in the lever-fitting type connector of the first aspect, the first connector housing has a lever insertion hole formed to allow the lever to be inserted therein and a plurality of lever-hold locking members formed around the lever insertion hole, for engagement with the lever inserted into the lever insertion hole.

According to the fifth aspects of the invention, owing to the formation of the lever-hold locking members around the lever insertion hole of the first connector housing, it is possible to ascertain an engagement of the lever with the first connector housing in advance of rotational manipulation of the lever for engaging the first connector housing with the second connector housing.

As the sixth aspect of the invention, in the lever-fitting type connector of the first aspect, the lever is provided, on an outer circumferential surface thereof, with a pair of screw grooves, and the second connector housing is provided with a pair of engagement projections which are accommodated in the screw grooves when engaging the first connector housing with the second connector housing.

According to the sixth aspect of the invention, owing to the engagement of the engagement projections of the second connector housing in the screw grooves formed on the lever, it is possible for an operator to manipulate the lever in its stable movement, improving the workability in engaging the first connector housing with the second connector housing.

These and other objects and features of the present invention will become more fully apparent from the following description and appended claims taken in conjunction with the accompany drawings.

DESCRIPTION OF THE PREFERRED EMBODIMENT

Figure 1:
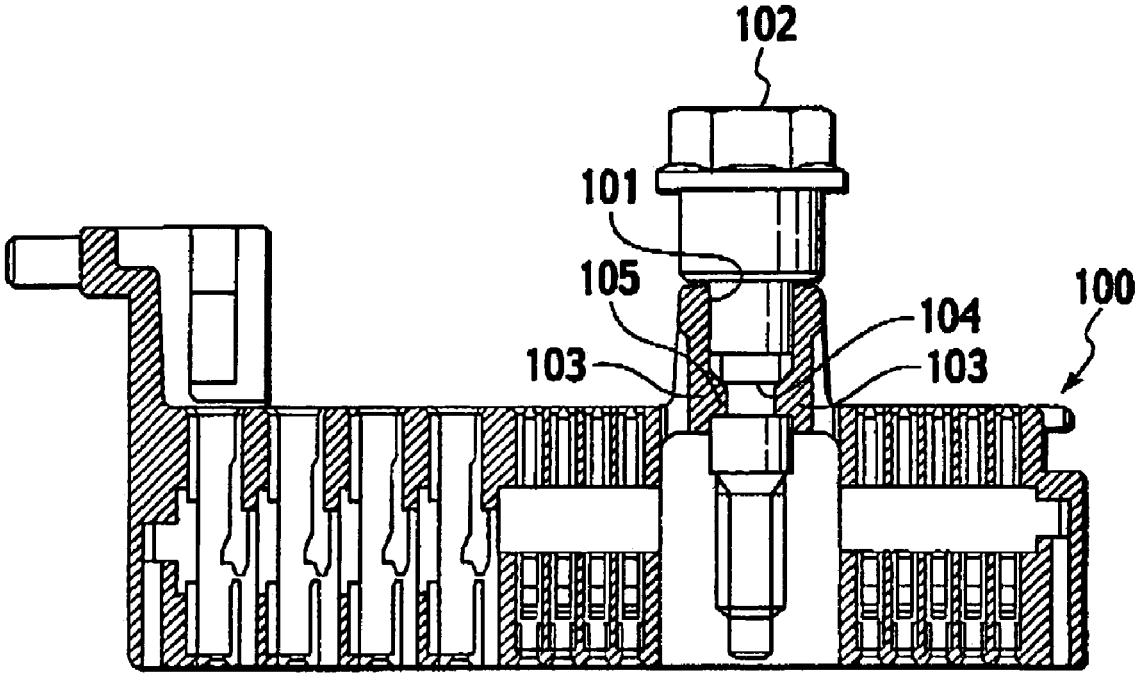
FIG. 1 PRIOR ART
FIG. 1 is a sectional view of a conventional connector.
Figure 2:
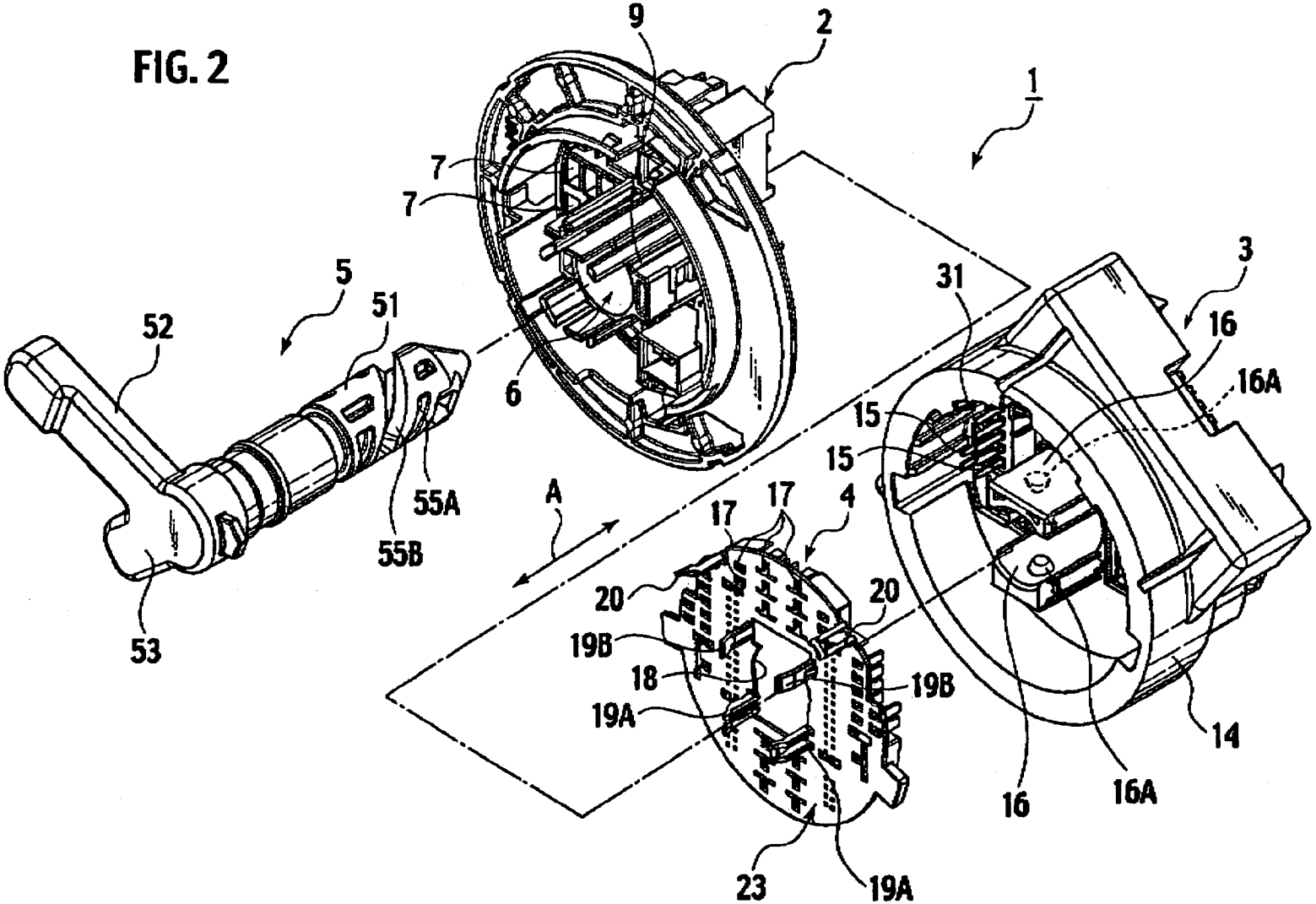
FIG. 2 is an exploded perspective view of a lever-fitting type connector in accordance with an embodiment of the present invention.

An embodiment of the present invention will be described with reference to the drawings. As shown in FIG. 2, a lever fitting type connector 1 of this embodiment is mainly formed by a female connector housing 2, a male connector housing 3, a moving plate 4 and a lever 5.

[Structure of Female Connector Housing]

As shown in FIG. 2, the female connector housing 2 has a lever insertion hole 6 formed as an insertion hole that penetrates the housing 2 in a fitting direction A (shown with an arrow in the figure). Around the lever insertion hole 6, a plurality of cavities 7 are formed to penetrate the housing 2 along the fitting direction A. In the cavities 7, there are accommodated and retained not-shown female terminals respectively.

The lever insertion hole 6 is formed in a shape of bore of a cylindrical body 9 projecting from the substantial center of the female connector housing 2 (non-fitting side) in the opposite direction to the fitting direction.

Figure 6:
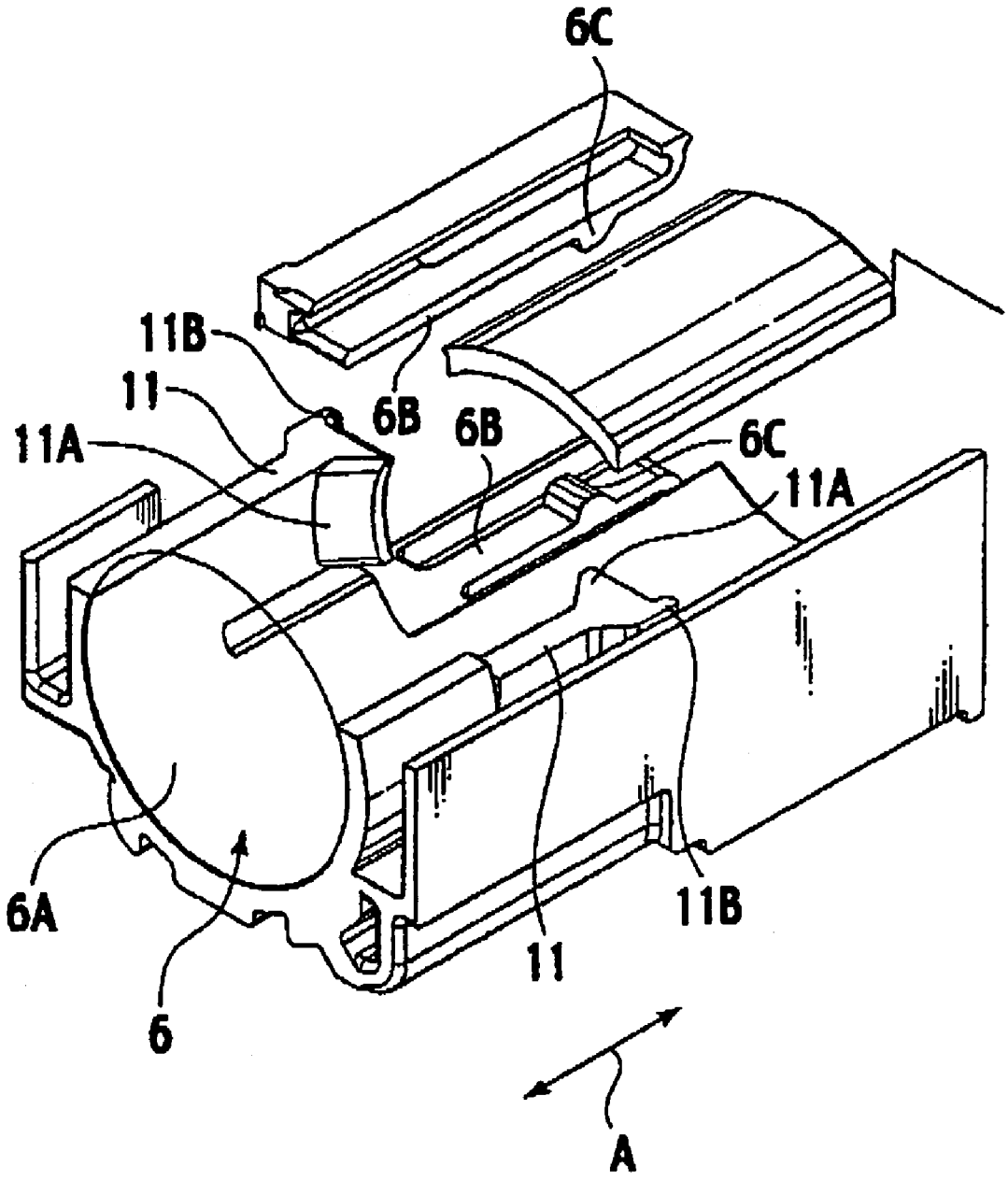
FIG. 6 is a perspective view of the substantial part of the female connector housing of the lever-fitting type connector of the embodiment.

On an inner wall of the lever insertion hole 6, lever-hold locking members 11 (see FIGS. 3 and 6) are formed so as to face the inner side of the lever insertion hole 6. These locking members 11 are respectively provided in the form of flexible arms. As shown in FIGS. 4 and 6, a pair of repelling pieces 6B are formed in opposing positions apart from the axis of the lever insertion hole 6. Additionally, the repelling pieces 6B are provided, at their intermediate parts, with engagement projections 6C for holding later-mentioned temporary engagement pieces 19 of the moving plate 4.

Figure 3:
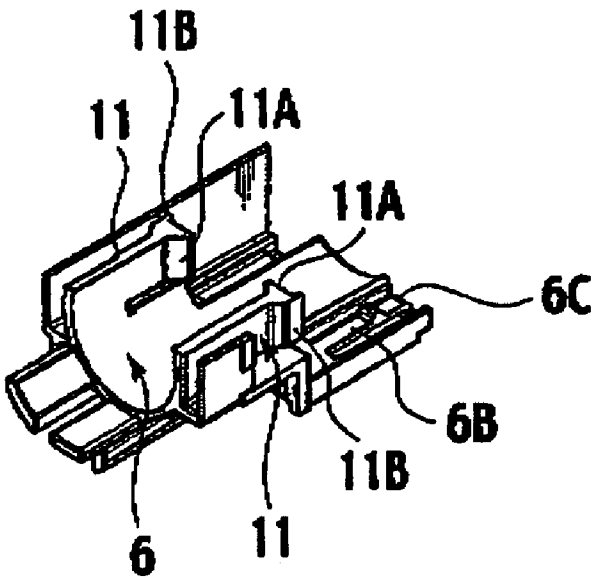
FIG. 3 is a perspective view showing respective substantial parts of both a lever and a female connector housing of the lever-fitting type connector of the embodiment.
Figure 3:
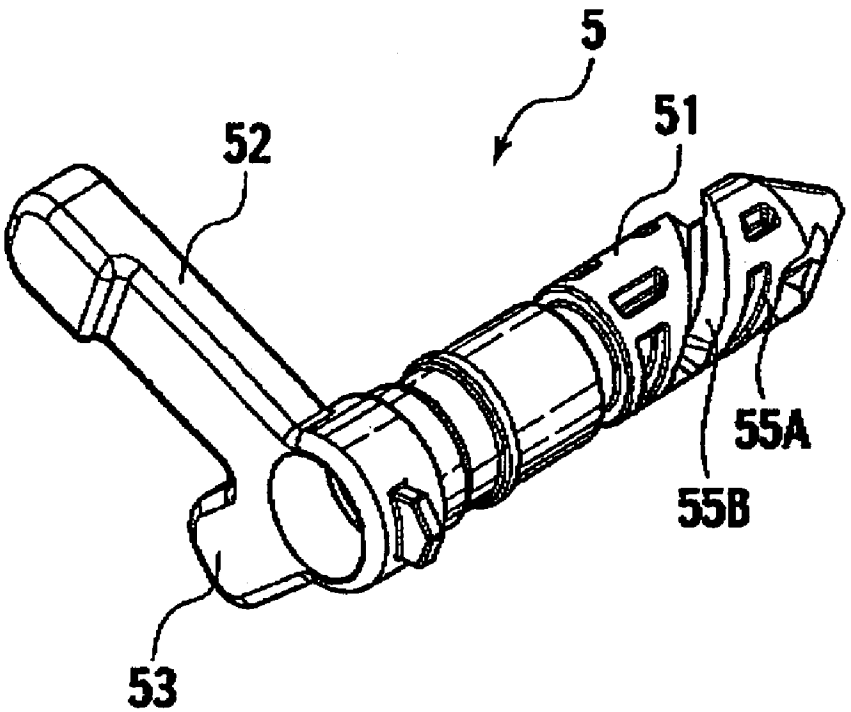
Figure 4:
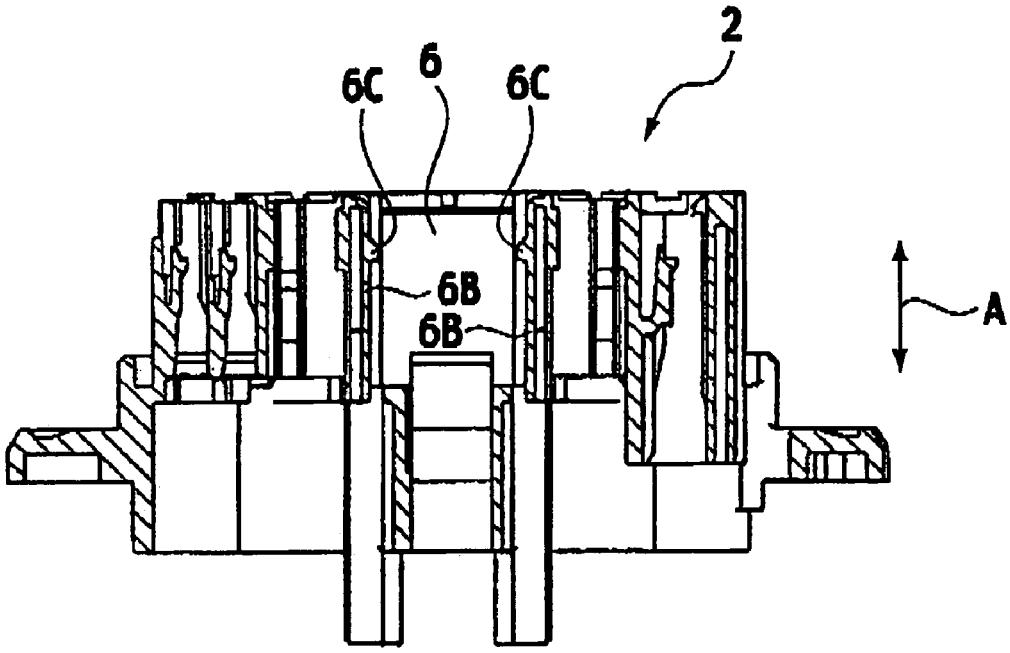
FIG. 4 is a sectional side view of the substantial past, showing the female connector housing of the lever-fitting type connector of the embodiment.

As shown in FIGS. 3 and 6, the lever-hold locking members 11 each form the inner wall of the lever insertion hole 6 partially. Each of the lever-bold locking members 11 is provided, at its free end, with a lever holding projection 11A projecting toward the inner side of the lever insertion hole 6. Further, at the exterior side of the fee end of each lever-hold locking member 11, a lever releasing projection 11B for hooking a not-shown releasing jig is formed so as to project toward the male connector housing 3 in the fitting direction A. Note, as shown in FIG. 6, the lever-hold locking members 11 have their base parts formed integrally with the inner wall 6A of the lever insertion hole 6, on their lever-inlet sides in the fitting direction A.

Figure 5:
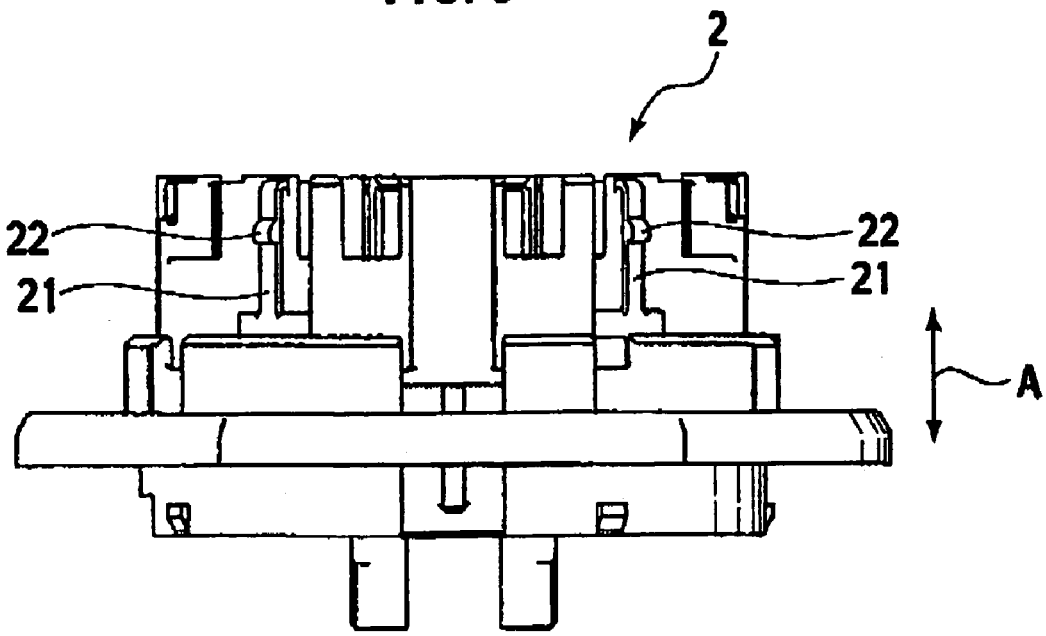
FIG. 5 is a side view of the female connector housing of the lever-fitting type connector of the embodiment.

As shown in FIG. 5, the female connector housing 2 is provided, on its circumferential face for engagement with the male connector housing 3, with a pair of repelling pieces 21 whose both ends in the fitting direction A are formed integrally with the outer wall of the housing 2. At respective intermediate parts of the repelling pieces 21, engagement projections 22 for holding temporary engagement pieces 20 of the moving plate 4 are formed so as to project outwardly.

[Structure of Male Connector Housing]

The structure of the male connector housing 3 will be described with reference to FIG. 2. The male connector housing 3 has a hood part 14 formed to project toward the female connector housing 2. In assembling, the female connector housing 2 is fitted in the hood part of the male connector housing 3. Further, in the hood part 14, a plurality of cavities 15 are formed in a main body of the male connector housing 3, along the fitting direction. A plurality of male terminals 31 are accommodated and fixed in the cavities 15 while projecting into the hood part 14.

At the substantial center of the male connector housing 3, a pair of lever engagement plates 16 are arranged so as to oppose to each other while projecting into the hood part 14. The lever engagement plates 16 are respectively provided with opposing surfaces that form the circumferential surface of an imaginary cylinder partially. Note, the opposing surfaces of the lever engagement plates 16 are dimensionally designed so as to make slide contact with the outer circumferential surface of the lever 5. On the opposing surfaces of the lever engagement plates 16, a pair of engagement projections 16A are formed so as to project at opposing positions of the so plates 16. When the lever 5 is engaged with the male connector housing 3, these engagement projections 16A are trapped and accommodated in a pair of screw grooves 55A, 55B formed on the outer circumferential surface of the lever 5.

[Structure of Moving Plate]

As shown in FIG. 2, the moving plate 4 has a plate body 23 shaped so as to be accommodated in the hood part of the male connector housing 3. Further, the plate body 23 is provided with a plurality of terminal insertion holes 17 into which male terminals 31 projecting in the hood part 14 of the male connector housing 3 are inserted respectively. The plate body 23 has a rectangular cutout 18 formed as one lever insertion hole allowing an insertion of the lever engagement plates 16 in pairs in the hood part 14 of the male connector housing 3. At four corners of the cutout 18, a pair of temporary engagement pieces 19A and a pair of temporary engagement pieces 19B are formed so as to project toward the female connector housing 2. In assembling, these temporary engagement pieces 19A, 19B come in slide contact with respective side surfaces of the lever engagement plates 16 of the male connector housing 3. In addition, the temporary engagement pieces 19A are engageable with the engagement projections 6C of the repelling pieces 6B of the female connector housing 2. At two positions in the circumference of the plate body 23 of the moving plate 4, a pair of temporary engagement pieces 20 are formed so as to project toward the female connector housing 2. In assembling, the temporary engagement pieces 20 come in slide contact with an inner wall of the hood part 14 of the male connector housing 3. Further, the temporary engagement pieces 20 are engaged with and also held by the engagement projections 22 of the repelling pieces 21 formed on the outer wall of the fitting part pf the female connector housing 2 (see FIG. 5).

Figure 9:
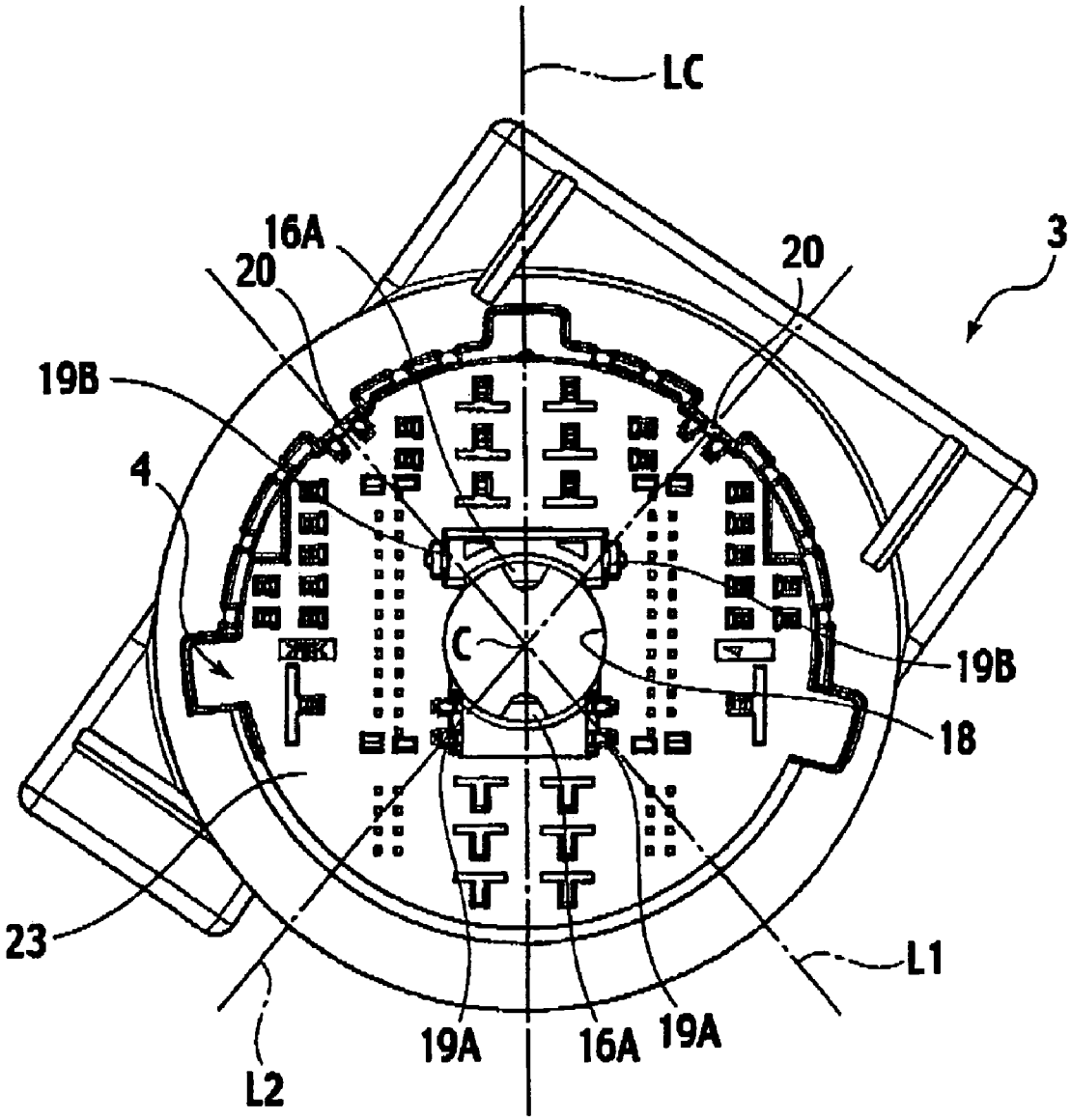
FIG. 9 is a front view showing a state where the moving plate is accommodated in a male connector housing of the lever fitting type connector of the embodiment.

The positional relationship among the temporary engagement pieces 19A, 19B and 20 will be described with reference to FIG. 9. FIG. 9 is a front view showing the moving plate 4 being accommodated in the male connector housing 3.

According to the embodiment, as shown in FIG. 9, a lever body 51 of the lever 5 is inserted into the center of the rectangular cutout 18 formed in the plate body 23 penetratively. Being selected from various lines perpendicular to a rotating axis C of the lever body 51 inserted into the cutout 18, the temporary engagement pieces 19A, 19B and 20 are positioned on imaginary lines L1, L2 being two diagonal lines of the rectangular cutout 18. Further, as shown in FIG. 9, the temporary engagement pieces 19A are arranged on one side of the rotating axis C as the basis of positioning, while the temporary engagement pieces 19B, 20 are arranged on the other side of the rotating axis C.

As mentioned above, since the temporary engagement pieces 19A, 19B and 20 are arranged on the lines L1, L2 perpendicular to the rotating axis C of the lever body 51 inserted into the moving plate 4 and also arranged on both sides of the rotating shaft C, when a pressure on the side of the female connector housing 2 is applied on the plate body 23 of the moving plate 4, the temporary engagement parts 19A, 19B and 20 are each subjected to substantially uniform pressures, allowing the plate body 23 to be prevented from being inclined to the male connector housing 3. As a result, it becomes possible to move the moving plate 4 smoothly in engaging the male connector housing 2 with the female connector housing 2 and also possible to ensure appropriate distances among the male terminals 31 in the male connector housing 3, accomplishing certain engagement between the male connector housing 3 and the female connector housing 2.

Additionally, since the temporary engagement pieces 19A, 19B and 20 in respective pairs are positioned symmetrically with each other on both sides of a center line LC (shown with a broken line of FIG. 9), the moving plate 4 can be engaged with the male connector housing 3, effecting certain engagement between the male connector housing 3 and the female connector housing 2.

[Structure of Lever]

Figure 10:
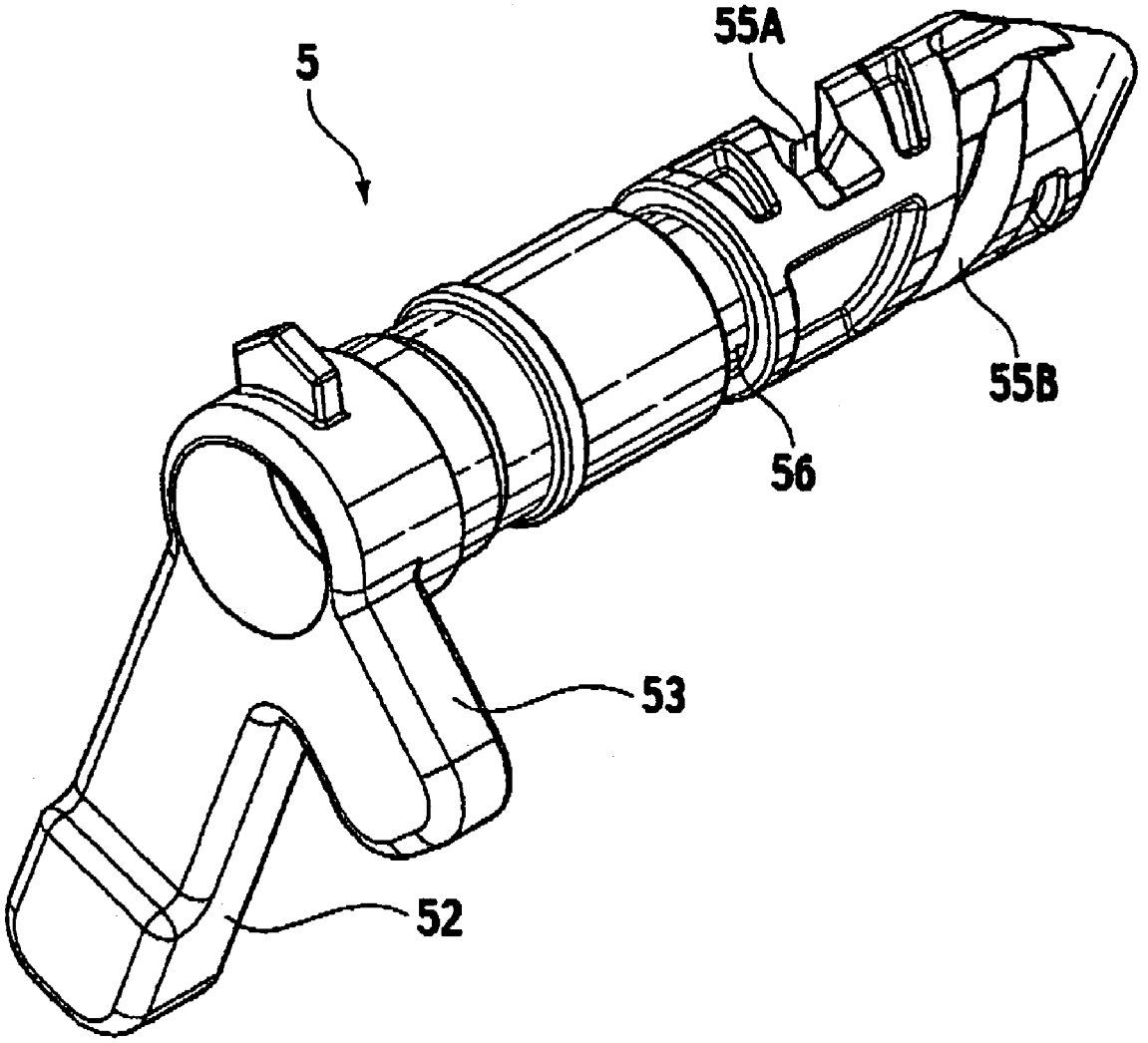
FIG. 10 is a perspective view showing a lever of the lever fitting type connector of the embodiment.

The structure of the lever 5 will be described with reference to FIGS. 2, 3 and 10. The lever 5 of the embodiment is formed by a lever body 51 to be inserted into the female and male connector housings 2, 3 and handling parts 52, 53 formed at the rear end of the lever body 51, for an operator's manual operation. In the lever 5, the handling part 52 forms one gripping part in the form of a relatively-long rod perpendicular to the lever body 51. While, the handling part 53 is arranged so as to be perpendicular to the lever body 51 at a predetermined angle (approx. 70 degrees in the embodiment) to the handling part 52.

The lever body 51 is formed to have a length allowing the lever 5 to penetrate the lever insertion hole 6 of the female connector housing 2 and also making the leading end of the lever body 5 reach up to an interval between the opposing lever engagement plates 16 of the male connector housing 3 under condition that the female connector housing 2 is not engaged with the male connector housing 3 but abutting on it.

The end portion of the lever body 51 is gradually tapered off as approaching its leading tip. With this tapered structure of the end portion, the lever body 51 of the lever 5 can be inserted and guided between the opposing lever engagement plates 16 of the male connector housing 3 with ease.

Additionally, on the outer circumferential surface of the lever body 51, a pair of screw grooves 55A, 55B both going into approx. 360-degree roll from the leading end of the lever 5 are formed in parallel with each other so as to spirally extend from opposite circumferential faces of the leading end as the starting points.

[Operation and Action of Lever-Fitting Type Connector]

The operation and action of the lever-fitting type connector of the embodiment will be described below.

(Engagement)

Figure 8:
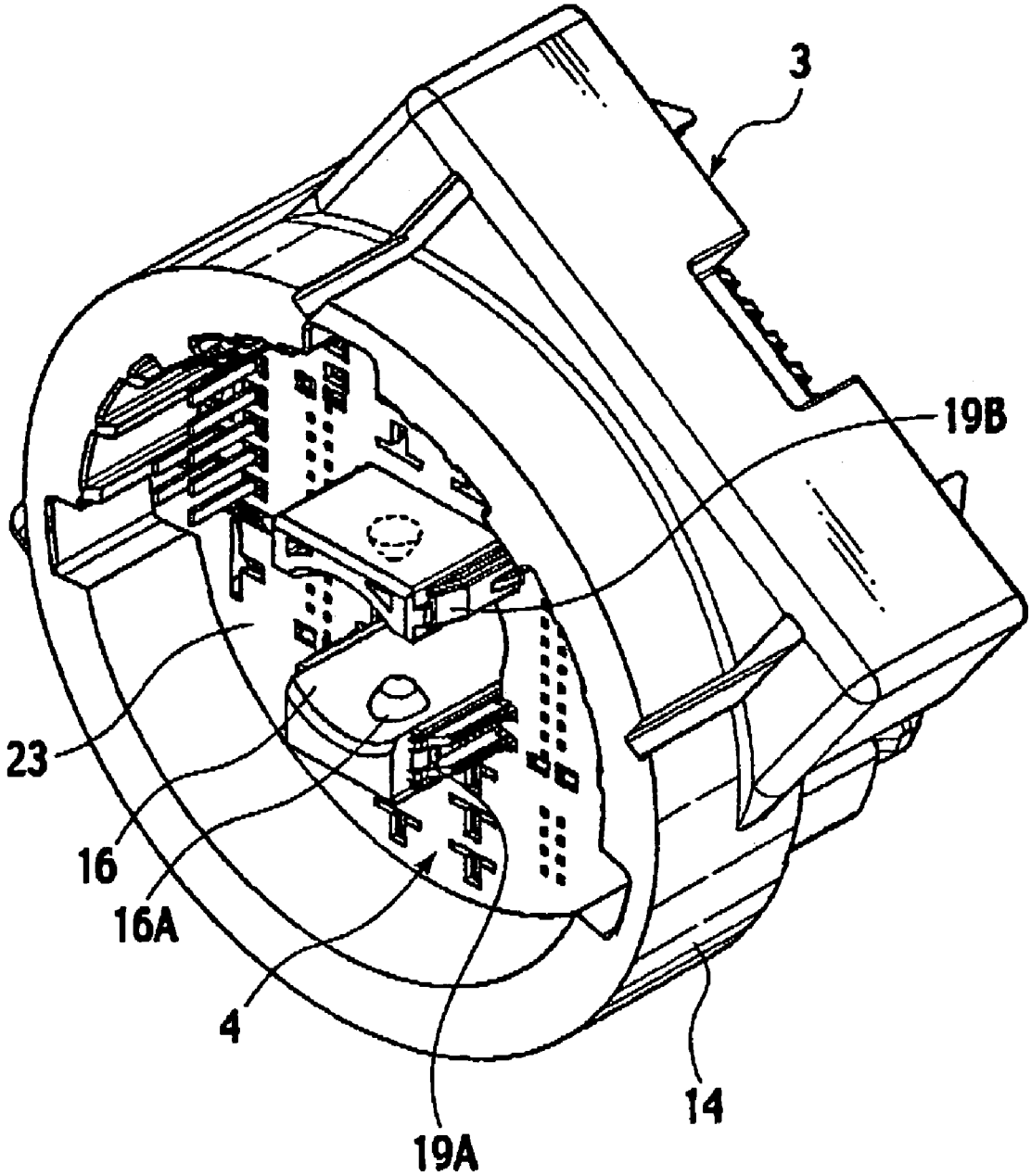
FIG. 8 is a perspective view showing a state where a moving plate is accommodated in a male connector housing of the lever fitting type connector of the embodiment.

First of all, as shown in FIGS. 2 and 8, the moving plate 4 is accommodated in the male connector housing 3. Then, the male terminals 31 projecting in the hood part 14 of the male connector housing 3 are respectively inserted into the terminal insertion holes 17 formed in the moving plate 4.

Figure 7:
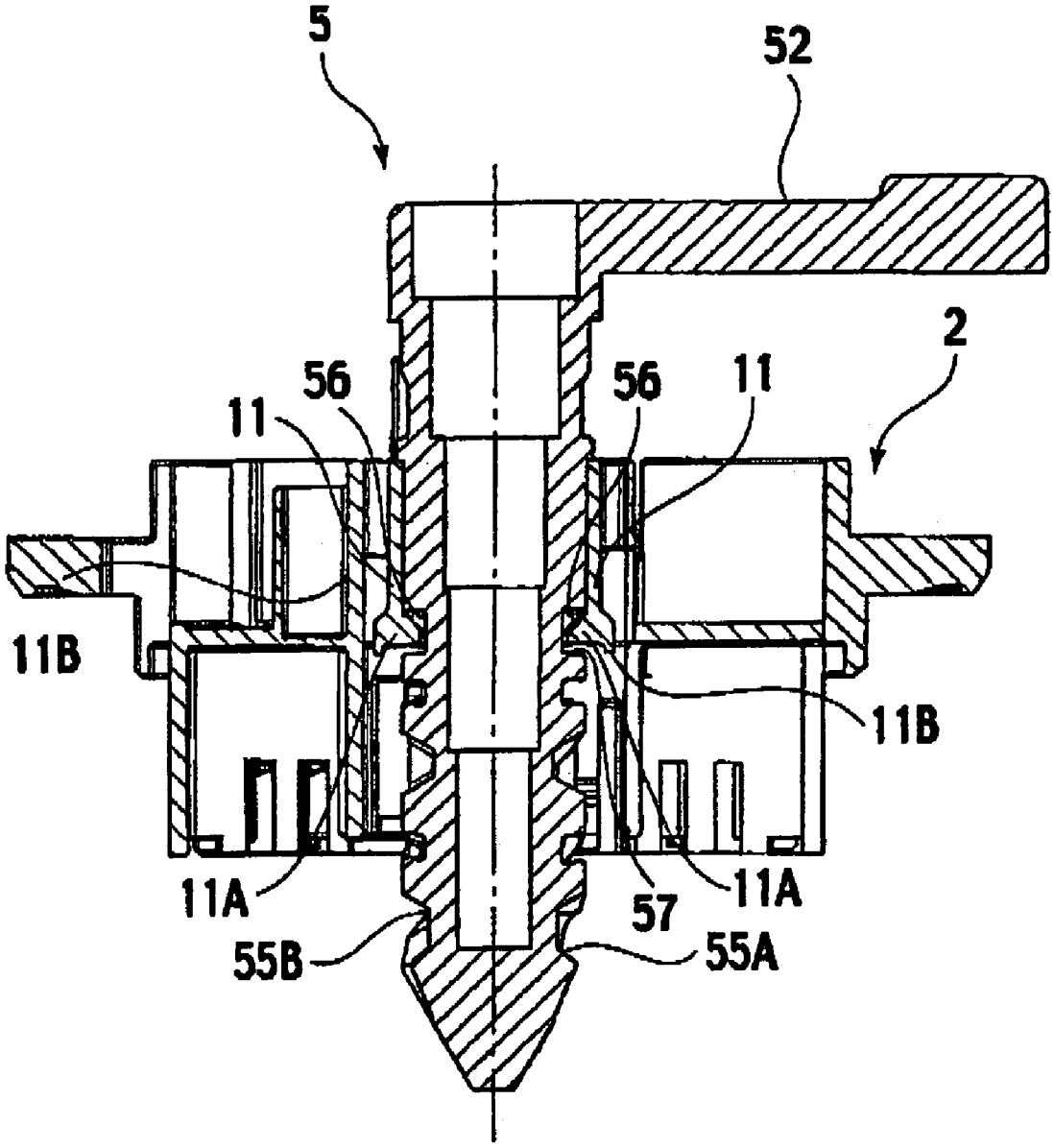
FIG. 7 is a sectional view showing a state where the female connector housing of the lever-fitting type connector of the embodiment is engaged with a lever.

Next, the female connector housing 2 and the male connector housing 3 are temporarily engaged with each other while aligning respective joint faces of the housings 2 and 3. The lever 5 is inserted into the lever insertion bole 6 of the female connector housing 2. Then, as shown in FIG. 7, the lever holding projections 11A of the lever-hold locking members 11 climb over the wall parts 57 of the lever 5 and successively fall in the latch grooves 56 due to the repulsion of the members 11. In this state, the lever body 51 is prevented from going back and forth by the lever holding projections 11A, establishing a condition where the lever 5 is temporarily engaged with the female connector housing 2.

Next, in the shown embodiment, the handling parts 52, 53 of the lever 5 in such temporary engagement are rotated in a counter-clockwise direction. As a result of the rotation, the leading ends of the screw grooves 55A, 55B of the lever 5 take up the engagement projections 16A of the lever engagement plate 16 of the male connector housing 3. In other words, the engagement projections 16A are accommodated in the screw grooves 55A, 55B and subsequently, the female connector housing 2 and the male connector housing 3 approach each other for their engagement with the rotation of the lever 5.

When the lever 5 temporarily engaged with the female connector housing 2 is rotated by a predetermined angle (approx. 270 degrees in this embodiment), the engagement projections 16A respectively reach the rear ends of the screw grooves 55A, 55B.

In the course of engaging the female connector housing 2 with the male connector housing 3, the plate body 23 of the moving plate 4 moves toward the bottom of the hood pant 14 of the male connector housing 3 while being urged by the end face of the fitting part of the female connector housing 2. Then, the temporary engagement pieces 19A, 19B and 20 of the plate body 23 also slide on the sidewall of the lever engagement plate 14 and the inner wall of the hood part 14. Since the temporary engagement pieces 19A, 19B and 20 are arranged in the above-mentioned positional relationship, they are subjected to uniform pressures while the plate body 23 is being urged. Consequently, it is possible to prevent the plate body 23 from being biased and inclined to the male connector housing 3. Due to the prevention of inclination of the plate body 23 to the male connector housing 3, respective distances among the male terminals 31 projecting in the hood part 14 of the male connector housing 3 are maintained constant on the ground of the positional relationship of the terminal insertion holes 17 in the plate body 23, allowing the male connector housing 3 to be engaged with the female connector housing 2 appropriately.

Figure 11:
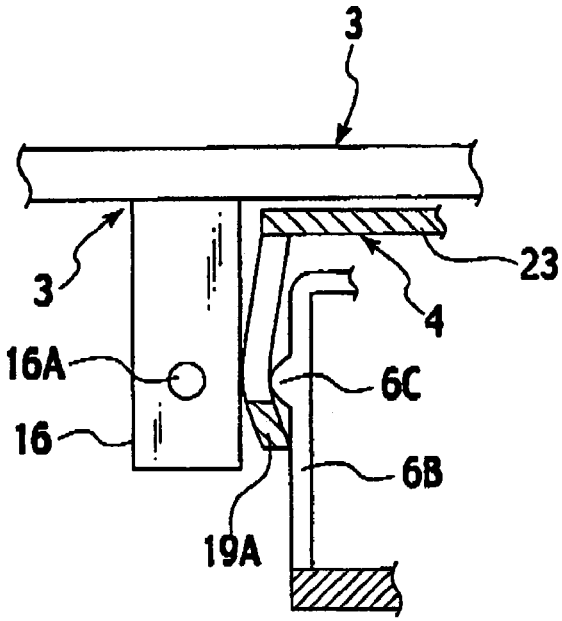
FIG. 11 is a sectional view of the substantial part of the lever fitting type connector of the embodiment, showing an engagement between the moving plate and the female connector housing.
Figure 12:
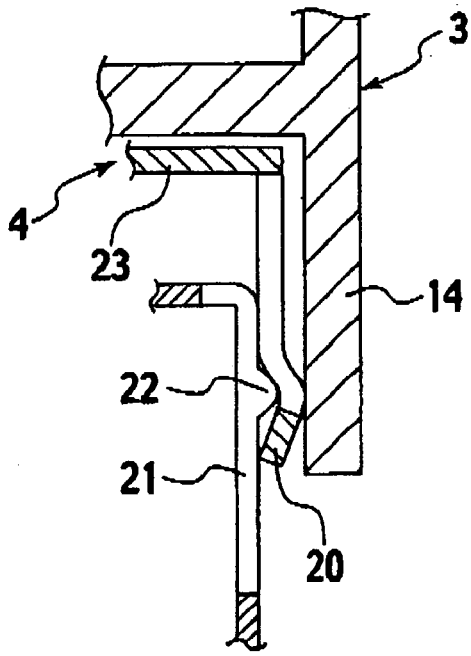
FIG. 12 is a sectional view of the substantial pant of the lever fitting type connector of the embodiment, showing an engagement between the moving plate and the female connector housing.

When the engagement between the female connector housing 2 and the male connector housing 3 is completed, as shown in FIG. 11, the engagement projections 6C of the repelling pieces 6B on the lateral side of the lever insertion hole 6 of the female connector housing 2 are engaged on the leading ends of the temporary engagement pieces 19A to hold the moving plate 4. Simultaneously, as shown in FIG. 12, the engagement projections 22 of the repelling pieces 21 formed on the outer wall of the fitting part pf the female connector housing 2 are engaged on the leading ends of the temporary engagement pieces 20 to hold the moving plate 4. In this way, since the moving plate 4 is held by the female connector housing 2 at the point of completing the engagement between the female connector housing 2 and the male connector housing 3, it becomes possible to prevent an occurrence of abnormal noise due to clattering and vibrations.

[Releasing Operation]

In the connector 1, the releasing of the female connector housing 2 from the male connector housing 3 is carried out as follows.

First of all, handling the handling parts 52, 53, an operator (not shown) rotates the lever 5 to the opposite direction to the engagement operation (i.e. the clockwise direction in this embodiment). With the rotation of the lever 5, the engagement projections 16A are guided up to the leading ends of the screw grooves 55A, 55B, so that the engagement between the female connector housing 2 and the male connector housing 3 is cancelled. In this state, however, since the lever holding projections 11A of the lever-hold locking members 11 are still accommodated in the latch grooves 56 due to the repulsion of the members 11, it is impossible to drag the lever body 51 out of the lever insertion hole 6 due to the abutment of the lever holding projections 11A on the wall parts 57 of the latch grooves 56.

Therefore, with the use of a releasing jig (not shown) or the like, it is carried out to deflect the lever releasing projections 11B outwardly, allowing the lever body 51 to move in the axial direction. In such a condition, it becomes possible to drag the lever body 51 out of the lever insertion hole 6. Note, in this state, the moving plate 4 is not held by the female connector housing 2 but remained in the hood part 14 of the male connector housing 3.

As mentioned above, according to the lever-fitting type connector 1 of the embodiment, since the temporary engagement pieces 19A, 19B and 20 in the form of repulsive arms come in slide contact with engaging parts of the male connector housing 3, the pressing of the female connector housing 2 allows the same pieces 19A, 19B and 20 to be slid with respect to the male connector housing 3.

In the lever-fitting type connector 1 of the embodiment, additionally, since the female connector housing 2 is provided with the repelling pieces 6B as the holding parts for holding the temporary engagement pieces 19A, 20 when engaging with the male connector housing 3, it is possible to prevent the moving plate 4 from rattling under the fitting condition of the connector, whereby the reliability in connection between the female connector housing 2 and the male connector housing 3 can be improved while preventing an occurrence of abnormal noise.

[Other Embodiments]

It will be understood by those skilled in the art that the foregoing descriptions are nothing but one embodiment of the disclosed lever-fitting type connector and therefore, various changes and modifications may be made to the present invention without departing from the spirit and scope of the invention.

For instance, although the temporary engagement pieces 19A, 19B and 20 are arranged on two lines L1, L2 in the above-mentioned embodiment, they may be arranged on three or more lines in the modification.

Additionally, although the lever 5 is temporarily engaged with the female connector housing 2 in the above-mentioned embodiment, it goes without saying that the lever 5 may be temporarily engaged with the male connector housing 3 in the modification.

It is noted that the female connector housing 2 and the male connector housing 3 are engaged with each other in the above-mentioned embodiment. Moreover, the invention is applicable to an arrangement where one connector housing on the side of a vehicle cabin is engaged with another connector housing on the side of an engine compartment through an automotive instrument panel. Then, a though-hole is formed in the automotive instrument panel, while one housing is held in the automotive instrument panel. Under such a situation, the other housing is temporarily engaged with the former housing from the opposite side of the instrument panel and successively, a lever on the side of the vehicle cabin is manipulated in rotation. As a results both of the connector housings can be engaged with each other, whereby the fitting operation of the connector can be facilitated.

What is claimed is:

1. A lever-fitting type connector comprising:

a first connector housing;

a second connector housing for engagement with the first connector housing;

a rod-shaped lever rotatably inserted into the first connector housing and held by the first connector housing so that rotation of the lever allows the second connector housing to be dragged to the first connector housing thereby engaging the first and second connector housings with each other;

a plurality of terminals arranged so as to project from a fitting surface of the second connector housing; and a moving plate interposed between the first connector housing and the second connector housing, the moving plate having a plurality of terminal insertion holes and one lever insertion hole formed to allow insertion of the terminals and the lever respectively, wherein the first connector housing is configured to slide the moving plate toward the second connector housing while keeping the terminals being inserted into the terminal insertion holes of the moving plate when the first connector housing is engaged with the second connector housing, the moving plate includes a plate body having the terminal insertion holes formed therein and a plurality of temporary engagement parts formed on the plate body to engage with the second connector housing temporarily, and the temporary engagement parts are arranged, on a plurality of lines perpendicular to a rotating axis of the lever in engagement with the second connector housing, on both sides of the rotating axis.

2. The lever-fitting type connector as claimed in claim 1, wherein the temporary engagement parts are positioned on both sides of a center line of a fitting end face of the second connector housing symmetrically.

3. The lever-fitting type connector as claimed in claim 1, wherein the temporary engagement parts are formed by a plurality of temporary engagement pieces in the form of arms projecting from the plate body toward the first connector housing; and the second connector housing is provided with a plurality of engaging parts allowing the temporary engagement pieces to be slidably engaged therewith.

4. The lever-fitting type connector as claimed in claim 3, wherein the first connector housing is provided with a plurality of holding parts for holding the temporary engagement parts when the first connector housing is engaged with the second connector housing.

5. The lever-fitting type connector as claimed in claim 1, wherein the first connector housing has a lever insertion hole formed to allow the lever to be inserted therein and a plurality of lever-hold locking members formed around the lever insertion hole, for engagement with the lever inserted into the lever insertion hole.

6. The lever-fitting type connector as claimed in claim 1, wherein the lever is provided, on an outer circumferential surface thereof, with a pair of screw grooves; and the second connector housing is provided with a pair of engagement projections which are accommodated in the screw grooves when engaging the first connector housing with the second connector housing.

* * * * *